United States Patent [19]

Heckmann et al.

[11] 4,140,158

[45] Feb. 20, 1979

[54] PIPELESS FILLING UNIT FOR COUNTERPRESSURE BOTTLING MACHINES

[75] Inventors: Werner Heckmann; Uwe Knabe, both of Dortmund, Fed. Rep. of Germany

[73] Assignee: Holstein und Kappert GmbH, Dortmund, Fed. Rep. of Germany

[21] Appl. No.: 913,866

[22] Filed: Jun. 8, 1978

[30] Foreign Application Priority Data

Jun. 21, 1977 [DE] Fed. Rep. of Germany ..... 2727724

[51] Int. Cl.[2] ..... B65B 3/26; B67C 3/06

[52] U.S. Cl. ..... 141/39; 141/286

[58] Field of Search ..... 141/1, 48, 37, 39, 40, 141/49, 52–54, 57, 58, 63, 64, 192, 197, 198, 227, 302, 303, 286, 392, 4–8

[56] References Cited

U.S. PATENT DOCUMENTS 3,604,480 9/1971 Reichert et al. ..... 141/39

*Primary Examiner*—Houston S. Bell, Jr.

*Attorney, Agent, or Firm*—Michael J. Striker

[57] ABSTRACT

A filling unit without filling pipe has a siphon closure for defining the level of the liquid charge in the bottle being filled. The siphon closure includes a stopper bell projecting into an annular channel for retaining sealing liquid, the stopper bell has in the range above the annular channel apertures in the form of radially and vertically directed slits extending downwardly to the edge of the bell-shaped jacket so that the lower part of the stopper bell has a comb-like configuration.

3 Claims, 2 Drawing Figures

PIPELESS FILLING UNIT FOR COUNTERPRESSURE BOTTLING MACHINES

BACKGROUND OF THE INVENTION

This invention relates generally to bottling machines and more specifically it relates to a filling unit for use in a counterpressure bottling machine, the filling unit operating without filling pipe and using siphon closure means for limiting the level of charge in the bottle, the siphon closure means including a stopper bell cooperating with an annular siphon channel in the discharging channel for the liquid, the stopper bell having on its upper part apertures for intercepting pulp particles from the liquid.

Filling units of this type are used chiefly for discharging $CO_2$-containing liquids that are discharged from a rotary pressure tank of the bottling machine into a bottle connected to the unit. Before initiating the proper filling operation, the pressure between the bottle and the pressure tank is first equalized so that the liquid is discharged in the bottle by the effect of gravity. The gas contained in the bottle is forced by the liquid to return in the tank. For the gas return serves a gas return pipe projecting into the bottle to a level corresponding to the desired charge level and as soon as the liquid discharge in the bottle reaches the opening of the gas return pipe the discharging process is automatically limited because the exchange of the gas for the liquid no longer takes place. A disadvantage of prior-art valves of this kind is in the danger that a quantity of gas occurring above the liquid level in the bottle may bubble up and cause an additional discharge of the liquid above the valve seat in the liquid discharging channel. To avoid this disadvantage, it has been devised to make the valve seat in the form of a siphon including a stopper bell that has its lower rim portion immersed in the sealing liquid contained in an annular siphon channel. This arrangement reduces slightly the efficiency of the filling unit. In order to avoid this disadvantage, a plurality of small apertures have been made in the upper part of the stopper bell above the bell-shaped jacket immersed in the sealing liquid so that these small apertures increase the effective cross-section of the discharging passage during the filling or discharging process. Nonetheless, it has proved that despite of this increase of the cross-sectional area of the liquid discharging channel by means of such additional apertures no substantial increase of the efficiency of the filling unit has been achieved because especially in fluid pulp containing liquids the small apertures became clogged with the pulp fibers and the effect of these apertures is lost.

SUMMARY OF THE INVENTION

A general object of this invention is therefore to overcome the aforementioned disadvantages.

In particular, it is an object of the present invention to provide an improved filling unit that avoids the clogging of the apertures in the upper part of the stopper bell in the siphon closure.

Another object of this invention is to provide reliable self-cleaning of the siphon closure.

An additional object of the invention is to provide a self-cleaning action by means of the stream of the discharged liquid both in the vertical and in the radial direction on the stopper bell without the necessity of taking additional construction measures.

In keeping with these objects, and others which will become apparent hereafter, one feature of the invention resides in a filling unit of the aforedescribed type in which the apertures in the upper part of the stopper bell are extended to the bottom rim of the bell and have the form of vertically and radially directed slits so that the lower part of the stopper bell has a comb-like configuration.

In a modification of this invention, the number and/or the width of the longitudinal slits is larger on the adverse side of the stopper relative to the axis of rotation of the bottling machine than on the side facing the axis of rotation.

It has been proved as advantageous when the slits have a width within the range of 0.4 to 0.8 millimeters.

The invention maintains the advantageous closing effect of the siphon closure means without loosing the efficiency of operation of the filling unit. The clogging of the stopper bell occurring in the conventional filling units of this type especially in discharging fluid pulp containing beverages is effectively prevented by the resulting self-cleaning effect due to the stream of the discharged liquid that automatically rinses away the pulp fibers from the comb-like arrangement of the stopper bell so that increased efficiency of the discharging process is attained.

The novel features which are considered as characteristic for the present invention are set forth in particular in the appended claims. The invention itself, however, both to its construction and its method of operation, together with additional objects and advantages thereof, will be best understood from the following description of the specific embodiments when read in connection with the accompanying drawings.

DESCRIPTION OF THE PREFERRED EMBODIMENTS

Figure 2:
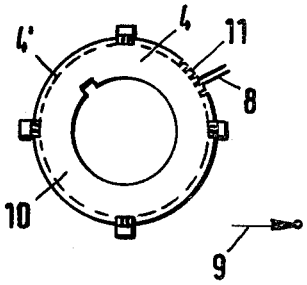
FIG. 2 is a top view of the stopper bell in the device of FIG. 1.
Figure 1:
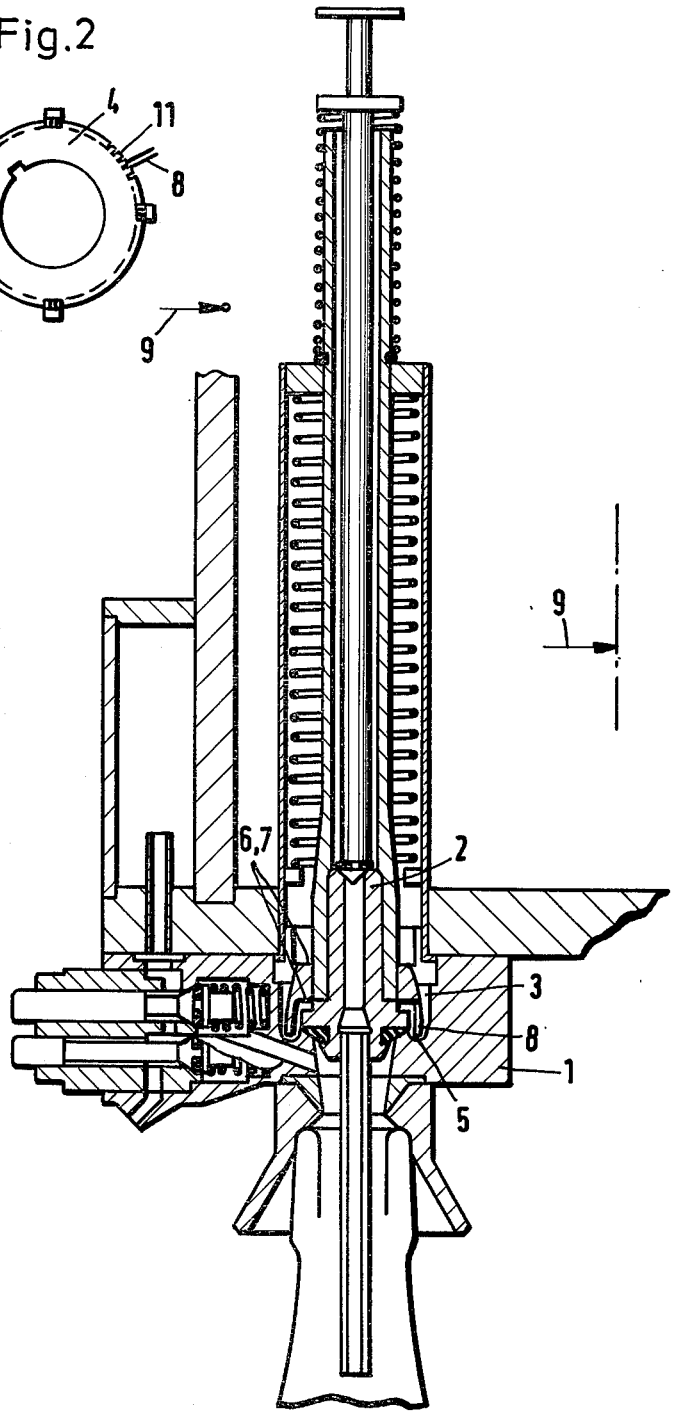
FIG. 1 is a sectional view of the filling unit according to this invention.

In the exemplary embodiment shown in FIG. 1, the filling unit includes a valve body 1 connected to the bottom of a rotary liquid tank and communicating with the interior of the tank by means of a liquid discharging channel or pipe in which is arranged for axial movement a valve pipe 2 that abuts against a seat provided in the liquid discharging passage in the valve body 1. Around the seat, a closure in the form of an annular groove or channel is arranged for cooperating with a stationary stopper bell 4 that together with the annular channel forms siphon closure means. In the shown embodiment, the stopper bell 4 is secured to the valve body 1 by means of four radial projections or supporting arms and its central boring serves for guiding the axially movable valve tube 2. By this arrangement the conventional guiding means that hitherto has been necessary for stabilizing the movement of the valve tube 2, are dispensed with. An axial recess 7 is provided in the inner wall of the upper part of the stopper bell 4 to guide a matching projection 6 in the valve tube 2 thus preventing rotation of the valve tube.

According to this invention, the bell-shaped jacket forming the lower part of the stopper bell 4 is provided with a plurality of vertically and radially directed slits 8 extending down to the bottom edge of the bell so that the lower part of the stopper bell 4 has a comb-like configuration. This configuration makes it possible to intercept pulp fibers that normally are deposited on the upper surface of the bell and the liquid stream passing through the slits rinses away these fibers so that no reduction in the cross-sectional area of the discharge passage takes place. The width of these slits is preferably between the range of 0.4 to 0.8 millimeters and in the same range of millimeters is the width of respective teeth resulting between the slits.

According to the type of the bottling machine the number and/or the width of the slits 8 can be adjusted according to their position with respect to the axis 9 of rotation of the machine; for example, the adverse side 10 has a greater number of slits than the side 11 facing the axis so that additional flow forming components in the liquid discharge channel are generated by the rotation of the machine and the overall efficiency of the filling unit is increased.

It will be understood that each of the elements described above, or two or more together, may also find a useful application in other types of constructions differing from the types described above.

While the invention has been illustrated and described as embodied in a filling unit for use in connection with a rotary tank of a counterpressure bottling machine, it is not intended to be limitied to the details shown, since various modifications and structural changes may be made without departing in any way from the spirit of the present invention.

What is claimed as new and desired to be protected by Letters Patent is set forth in the appended claims:

1. In a counterpressure bottling machine having a liquid tank, a filling unit comprising a liquid discharging tube projecting into the tank and accommodating an axially displaceable valve tube; a valve body secured to the external surface of the tank and defining a valve seat communicating with said liquid discharging channel and forming with said valve tube a liquid discharging valve; and siphon closure means, including an annular siphon groove surrounding said valve seat in said valve body, and a stationary stopper bell secured in position in said liquid discharging channel in said valve body and defining a center bore adapted for guiding said axially displaceable valve tube, a lower part of said bell projecting into said annular groove and being provided with a plurality of vertically and radially directed slits extending through the wall and to the bottom edge of the bell to form a comb-like configuration.

2. A filling unit as defined in claim 1, wherein the number and/or the width of the slits is larger on the adverse side of the bell relative to the axis of rotation of said machine than on the side facing the axis of rotation.

3. A filling unit as defined in claim 1, wherein the width of said slits is within the range of 0.4 to 0.8 millimeters.

* * * * *